US005944239A

United States Patent [19]

Rogers et al.

[11] Patent Number: 5,944,239

[45] Date of Patent: Aug. 31, 1999

[54] FORWARD BIASED HANDGUN HOLSTER WITH LOCK

[75] Inventors: William H. Rogers; Norman E. Clifton, Jr., both of Jacksonville, Fla.

[73] Assignee: Safariland Ltd., Inc., Ontario, Calif.

[21] Appl. No.: 08/907,978

[22] Filed: Aug. 11, 1997

[51] Int. Cl.[6] ..... F41C 33/02

[52] U.S. Cl. ..... 224/193; 224/243; 224/911

[58] Field of Search ..... 224/193, 196, 224/243, 245, 911, 912, 242

[56] References Cited

U.S. PATENT DOCUMENTS

| | | | |
|---|---|---|---|
| 653,779 | 7/1900 | Phillips | 224/911 |
| 1,148,935 | 8/1915 | Snavely | 224/243 |
| 2,051,844 | 8/1936 | Green | 224/911 |
| 3,252,639 | 5/1966 | Sloan | 224/243 |
| 3,630,420 | 12/1971 | Bianchi | 224/193 |
| 3,718,240 | 2/1973 | Rose | 224/243 |
| 3,902,639 | 9/1975 | Rogers | 224/243 |
| 4,273,276 | 6/1981 | Perkins | 224/243 |
| 4,286,741 | 9/1981 | Rogers | 224/193 |
| 4,542,841 | 9/1985 | Bianch et al. | 224/193 |
| 4,694,980 | 9/1987 | Rogers | 224/243 |
| 4,858,799 | 8/1989 | Young | 224/243 |
| 5,518,155 | 5/1996 | Gallagher | 224/911 |

*Primary Examiner*—Renee S. Luebke
*Attorney, Agent, or Firm*—Arthur G. Yeager

[57] ABSTRACT

An holster includes a biasing member that forces a handgun forwardly in a holster such that the handgun engages one or more molded ledges in the inner cavity of the holster and allows withdrawal only by way of a specific series of steps. The biasing member includes an engaging member that carries an axle-mounted roller and forces the roller against the handgun at a predetermined position. A spring may be mounted between the engaging member and a support body to which the engaging member is pivotably mounted. Positive locking devices are provided for the engaging member in some of the embodiments with some being releasable by a finger of a wearer or by movement of the handgun in a predetermined direction.

28 Claims, 7 Drawing Sheets

FORWARD BIASED HANDGUN HOLSTER WITH LOCK

BACKGROUND OF THE INVENTION

1. Technical Field

This invention generally relates to handgun holsters and more particularly concerns a holster with improved features to prevent inadvertent dislodgement or withdrawal of the handgun from the holster. The holster is designed to retain the handgun securely and yet to permit rapid withdrawal when required.

2. Prior Art

Most attacks on police officers by assailants trying to remove officers handguns from holsters have come from the front or side of officers and not from the rear. It is obvious that an assailant has more mechanical leverage as well as an unobstructed path by simply pulling forward and up on the handle of the weapon while standing in front facing the officer or facing him at his side. Holsters as typified by U.S. Pat. Nos. 3,630,420; 4,542,841; 4,273,276; and applicant's own U.S. Pat. Nos. 3,902,639; 4,286,741; and 4,694,980 attempt to make it difficult for an assailant to remove an officer's handgun from the rear.

Most securing straps of holsters might become unlocked in a violent attack. Because of this possibility, an internal locking method is incorporated in some of the prior art holsters to make it more difficult for the attacker to remove the handgun from the holster in an attack from the rear of the officer. Generally, the internal locking means engages the back recurve of the trigger guard or the top ledge of a cylinder of a revolver. In more recent times the popularity of the semiautomatic pistol has posed a problem in the design of a secure holster because this type of handgun has no cylinder ledges nor trigger guard recurves to serve as a locking point. An attempt to lock upon the forward portion of the trigger guard is not preferred because only a few models of semiautomatics offer a flat ledge at the forward portion of the trigger guard necessary for the locking action.

It is an object of this invention to provide an improved handgun holster which overcomes the deficiencies of the prior art, and is designed to provide a holster which secures the handgun from withdrawal by any but the wearer and yet permits a fast withdrawal upwardly by one trained in using the holster. It is another object to provide a holster that provides obstacles to one attempting an unauthorized withdrawal of the handgun from the front or side of the holster. Other objects will appear in the more detailed description which follows.

SUMMARY OF THE INVENTION

In one aspect of the present invention there is provided a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in the inner cavity to engage a portion of the handgun in the holster to inhibit withdrawal of the handgun upwardly prior to rearward movement of the handgun, the improvement comprising biasing means adapted to engage and force a handgun placed in the inner cavity forwardly.

Other aspects of the invention are seen wherein the biasing means includes an engaging member and a spring member, the spring member being mounted between the rear portion of the holster and the engaging member being mounted in the inner cavity of a holster in a manner to position the engaging member forward to engage a handgun placed in a the holster. The biasing means also includes selectively movable blocking means mounted to the holster and movable between first and second positions for inhibiting rearward movement of the engaging member when the blocking means is in the first position and permitting rearward movement of the engaging member when the blocking means is in the second position. The biasing means further includes selectively operable positive locking means for securing the engaging member in the first position. The selectively operable positive locking means may secure the engaging member in either the first position or the second position.

Additional aspects are seen by the selectively movable blocking means including a blocking element and a contact element, which may be mounted to the holster or to the support member, the blocking element attached to the contact element and movable thereby between the first and second positions, the blocking element positioned rearwardly of the engaging member in the first position to make contact with the engaging member when an attempt is made to move the engaging member rearwardly. The contact element being engaged by a finger of the wearer when the handgun is being gripped for removal in certain embodiments and engaged by the handgun in other embodiments.

Further aspects include the biasing apparatus having a support member and securing means to secure the support member to the rear portion of the holster. The spring element is mounted between the support member and the engaging member. The biasing apparatus also includes a roller element and means for mounting the roller element to the engaging member, the roller element engaging a handgun inserted in the inner cavity, the roller element providing for minimum frictional engagement between the surface of a handgun in contact with the engaging means to provide for ease of handgun withdrawal from and insertion into the holster.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENTS INTRODUCTION

Figure 1:
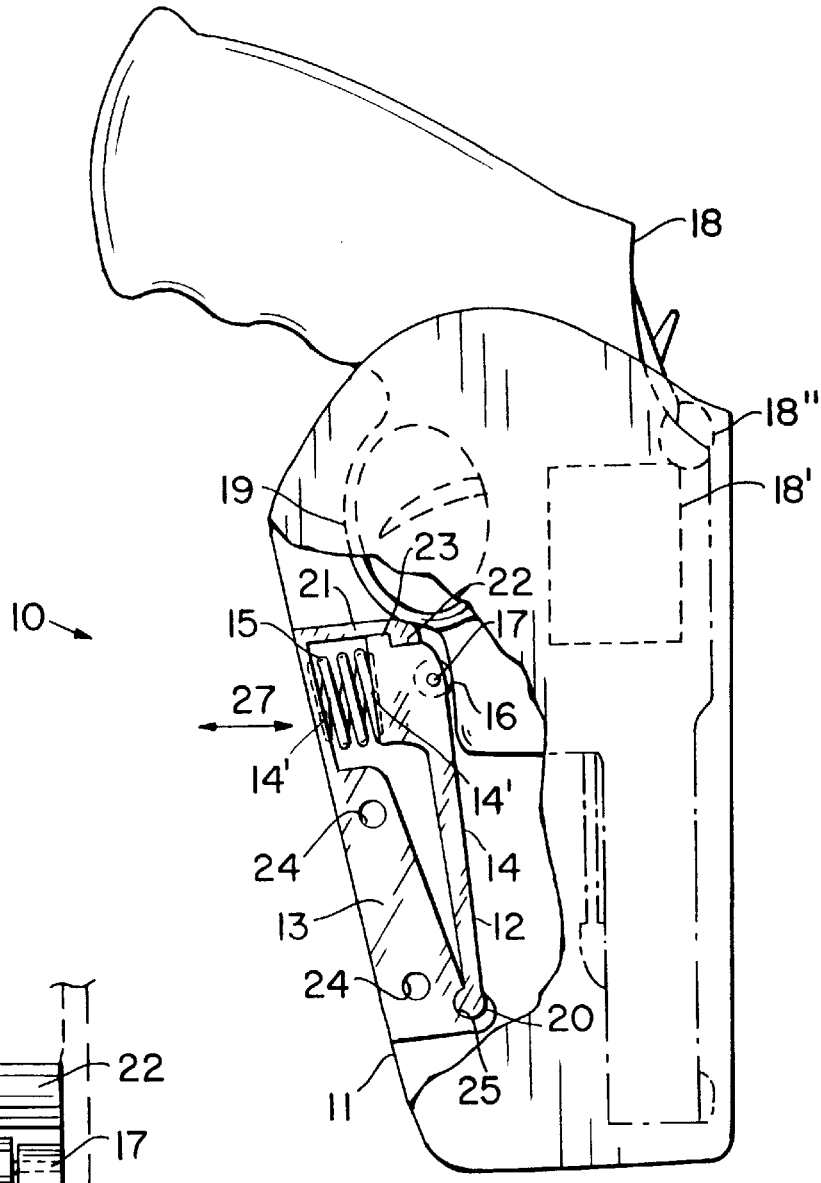
FIG. 1 is an outside elevational view of the handgun holster employing a first embodiment of the biasing apparatus of the present invention with part of the holster broken away for clarity.

A review of the holster of U.S. Pat. No. 4,694,980 will assist in an understanding of the present invention. The general features and components of this holster are the same as those of the holster in FIGS. 1–5 and 6–10 of patent '980. The outer wall and inner wall of the holster are shaped to define an interior cavity to fit a revolver as shown in dotted lines. The walls are preferably one piece folded in front and fastened together at the lower rear corner by a rivet. A lateral strap encircles the holster adjacent the open top and is affixed to the outer wall by a snap fastener and to inner wall by another fastener. The lateral strap has a slidable attachment to the inner wall embodying a slot and screw. The two ends of the lateral strap are joined together by a snap fastener with a finger engaging tab as an extension above the fastener. The top strap also extends over the top of the holstered revolver to a snap fastener and a finger engaging tab on the inner side of the holster adjacent the front portion. In this embodiment the top strap is a lateral extension of the lateral strap rather than of the outer wall. Similarly, the fastener and tab are on a lateral extension of the lateral strap rather than an extension of the inner wall. Since the lateral strap is permanently affixed to the outer wall and to the inner wall adjacent the front portion. It is optional to attach the top strap, the fastener and the tab to the lateral strap or to the walls.

The interior engaging ledges are fashioned to catch the edges of the cylinder of a revolver and prevent upward withdrawal of the revolver from the holster until the butt is rotated downward and rearward to permit the edges of the cylinder to clear the ledges. The rear edges of walls are held together by a rivet and the molded shape of the holster until the revolver is moved to cause the edges to spring apart near the top opening. The steps of withdrawing the handgun from the holster are identical regardless of whether the handgun is a semiautomatic or a revolver.

In the first step the hand grasps the butt of the handgun with the thumb pressing against the upper tab and the middle finger pressing against the other tab. These two fingers pushing toward the body of the wearer of the holster cause the two snaps to be unsnapped. In the second step the butt of the handgun is pulled backward causing the rear edges to spread apart to open the interior cavity sufficiently to loosen the handgun, and also to release the handgun from the engaging ledges.

The unsnapping of the fastener releases the lateral strap permitting it to slide with respect to the slot and pin which, in turn, permits the butt to be moved backward. In the third step the handgun is withdrawn upwardly from the holster. Unsnapping of the two fasteners releases the handgun for movement. The lateral strap is released by unsnapping the associated fastener allowing the strap to expand taking the general position shown in dotted lines. The butt can then be moved backward to the position shown in dotted lines. This movement is sufficient to release the handgun from the engaging ledges inside the holster permitting the handgun to be withdrawn upwardly to complete withdrawal from the holster.

The present invention is directed towards the simplification of the holster apparatus without any sacrifice of either safety or ease of use.

The present invention includes specific means to force a handgun in the holster forwardly to prevent upward movement of the gun against the stop means that is formed on the inner walls of the holster inner cavity. The means employed consists generally of the following components: first, a support member or body that is attached to the two sides of the holster and is mounted rearwardly. Second, a movable engaging member is mounted to the support member and engages the handgun usually at a point on the trigger guard thereof. Third, the engaging member is biased forwardly with a biasing member usually in the form of a coil spring. The engaging member must be moved rearwardly for the gun to be moved rearwardly a distance far enough to allow the gun to clear the holster stop means and thus to allow the gun to be withdrawn upwardly from the holster.

Movement of the engaging member rearwardly is accomplished by the user grasping the gun and pulling it rearwardly to overcome the spring resistance of the biasing member. In some embodiments of the project invention however, an additional first step must be positively taken by the user in order for the engaging member to move rearwardly. This step involves moving a blocking means that is normally located rearwardly of the engaging member. This step is independent of and prior to the rearward movement of the handgun. The embodiments of the present invention that employ the blocking means are those designed for high-risk environments such as uniformed police in urban areas where the likelihood of an attempt at wresting the gun away from the user is higher than in uses of the device by, for example, plainclothes policemen that employ a concealed holster.

Figure 2:
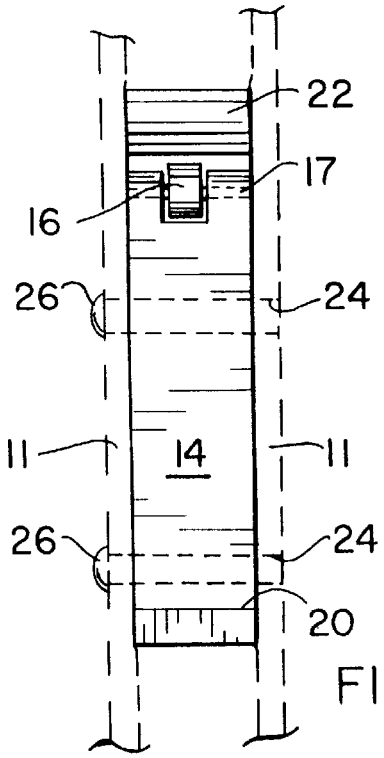
FIG. 2 is an enlarged partial front view of the biasing apparatus of FIG. 1.

In the first embodiment of the present invention illustrated at 10 in FIG. 1, the holster 11 is either of the revolver and semiautomatic types illustrated in FIGS. 1–10 of patent '980 and is illustrated in FIGS. 1 and 2. The improved biasing member 12 includes a support member or body 13 by which the apparatus is attached to the holster 11. The gun engaging member 14 is pivotably mounted in a slot 25 via flange 20 or other means as may be appropriate. Both support member 13 and engaging member 14 are made of low surface friction materials such as nylon or Teflon as understood in the art. Slots 14' provide bases to mount spring 15 as also understood in the art.

Engaging member 14 includes a roller element 16 mounted on an axle 17 that is forced against a portion of the gun 18 usually at or near the trigger guard 19. To provide for the return of the gun 18 to the holster 11, support element 13 includes a forwardly extending bracket portion 21 including a flange 22 that limits the forward travel of engaging member 14 by contact with upwardly extending boss 23 under the force of spring 15. The entire biasing member 10 is mounted to the two rear members of holster 11 via holes 24 that accept bolts and T-nuts 26 as understood in the art. Arrow 27 indicates the direction of movement of engaging member 14 and the roller 16 carried thereon.

The action of engaging member 14 is to force the gun 18 forwardly to engage the ledges 27, 37 of the '980 holster, shown as 18", by 18', to prevent an unsafe withdrawal of the gun 18. Accordingly, rearward movement of the gun 18 against the force of spring 15 is required for subsequent upward release of the gun from the holster 11.

In the preferred embodiment of the present invention, both straps 14 and 22 of the '980 patent can be eliminated, if so desired. Of course, if desired strap 22 may be retained particularly where no positive lock has been provided as will appear more clearly herebelow.

Figure 3:
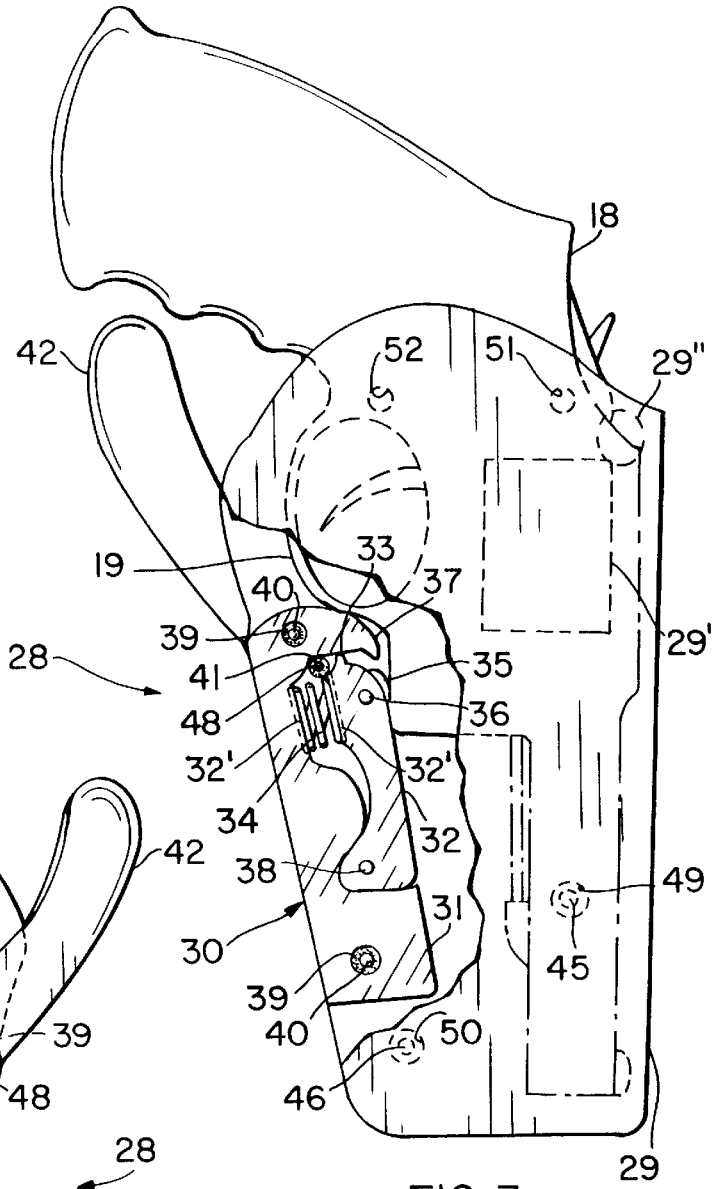
FIG. 3 is an outside elevational view of a second embodiment of the holster and biasing apparatus of the present invention.
Figure 4:
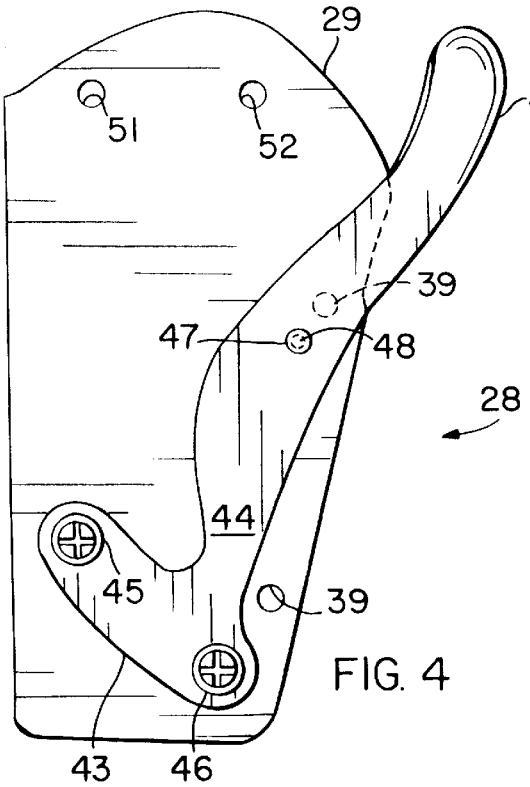
FIG. 4 is an inside elevational view of the holster of FIG. 3.

The second embodiment of the improved biasing apparatus is shown at 28 in FIGS. 3 and 4. FIG. 3 illustrates an outside wall or surface of the holster 29 with respect to a user. Holster 29 includes stop means 29" that engages the cylinder 29' of gun 18. The biasing member 30 includes a support member or body 31 to which is pivotally mounted engaging member 32 via axle 38. The body 31 is fixed to the holster via bolts 40 that fit into bolt holes 39. Roller 35 is mounted on axle 36.

Spring 34 is mounted in spaces 32' as before. Upstanding boss 33 and travel limit flange 37 also work as in the case of the first embodiment. However, the present apparatus 28 includes a blocking peg element or post 48 that is mounted via flange 47 in a rivet-like manner to lever 42 (FIG. 4) and is normally positioned in blocking post hole 41 in the space between engaging member 32 and body 31. Accordingly, engaging member 32 cannot be moved rearwardly until post 48 is pulled out of the hole 41 and thus out of the way of member 32.

A contact element in the form of lever 42 is illustrated in FIG. 4 and is shown mounted to the inside wall or surface of the holster 29 that is adjacent the body of a user. The lever 42 includes lower portion 43 mounted to holster 29 via bolts 45 and 46 and includes a reduced or weakened portion 44 that allows the upper portion of lever 42 to be moved outwardly a sufficient distance to retract post 48 laterally from blocking post hole 41 to allow for rearward motion of engaging member 32. The portion 44 is formed of a stiff plastic and is formed narrow and thin at 44 to provide for sufficient bending resiliency and motion, without breakage. Bolt holes 51 and 52 are used to attach holster 29 to a gun belt (not shown).

Figure 5:
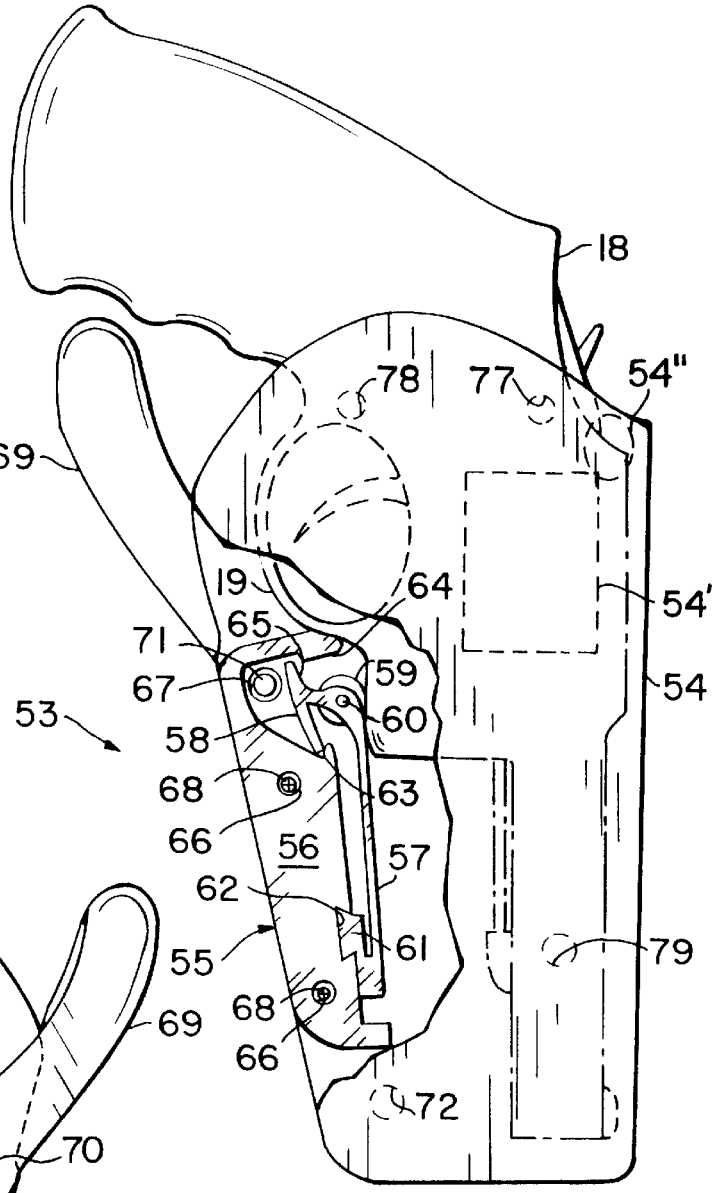
FIG. 5 is an outside elevational view of a third embodiment of the holster and biasing apparatus of the present invention.
Figure 6:
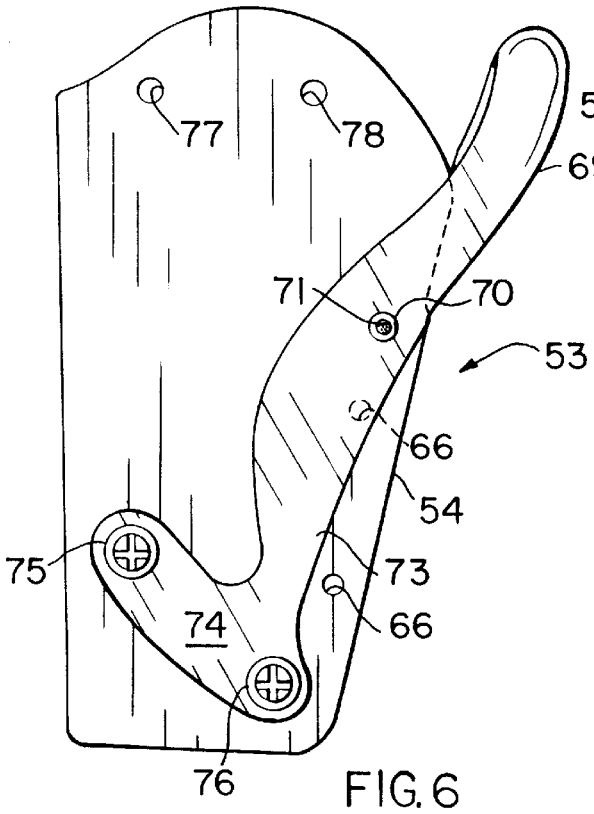
FIG. 6 is an inside elevational view of the holster of FIG. 5.

The third embodiment of the improved biasing apparatus is illustrated at numeral 53 in FIGS. 5 and 6. Holster 54 includes positive stop means 54" to engage the cylinder 54' of gun 18. Biasing member 55 includes body 56 and engaging member 57 formed as a leaf spring biasing forwardly having a roller 59 mounted on axle 60 forwardly of the biasing element 58 which is a portion of member 57. Travel limit bracket 64 engages the upper portion 65 of biasing element 58. Slot 62 is used to mount flange 61 of member 57 to body 56.

The lower portion of element 58 fits into slot 63. Rearward force against roller element 59 will cause biasing element 58 to move rearwardly provided blocking element or post 71 has been withdrawn from post hole 67. Bolt holes 72, 79 and 66 are used with bolts 75, 76 and 68 as shown. Bolt holes 77 and 78 mount the holster 54 to a gun belt (not shown).

FIG. 6 illustrates the lever 69 having lower fixed portion 74 and weak, bendable portion 73. Blocking post 71 is mounted via flange 70. Lever 69 is operated as is lever 4 in FIG. 4 by contact of a finger 81 of a wearer contacting the lever 69 as the hand grips the handgun without releasing the grip thereon.

Figure 7:
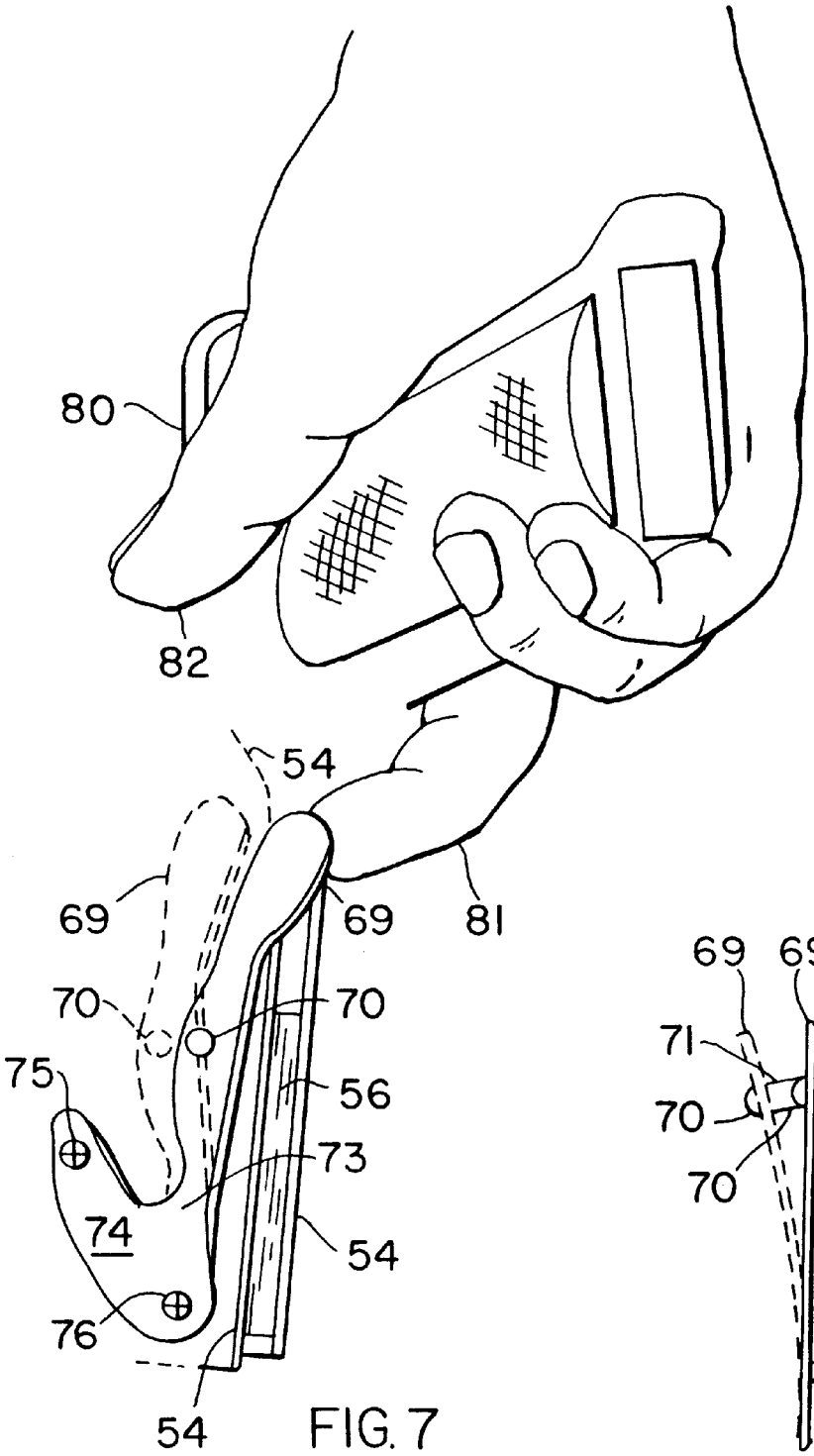
FIG. 7 is a perspective view showing how the improved biasing apparatus of FIGS. 3–6 is operated by a handgun user.
Figure 8:
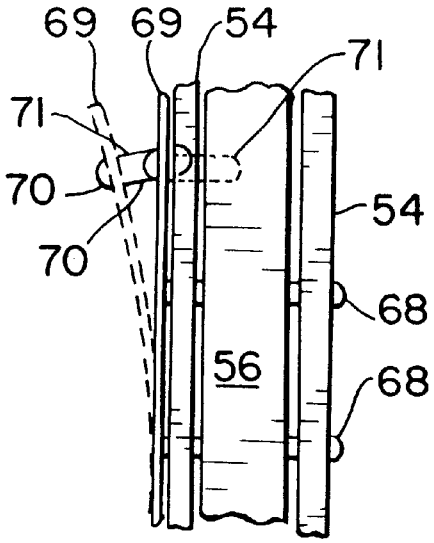
FIG. 8 is a partial front elevational view of the improved biasing apparatus being operated by a handgun user in FIG. 7.

FIGS. 7 and 8 illustrate a preferred means of operating a blocking post lever and is applicable either to lever 42 of FIG. 4 or to lever 69 of FIG. 6. The index finger 81 of a user may be used to push the lever 69 outward, as shown in dotted lines. This action is identical for a revolver such as gun 18 or a semiautomatic pistol 80 shown in FIG. 7. FIG. 8 shows the lateral movement of blocking post 71 when lever 69 is moved outwardly.

Figure 9:
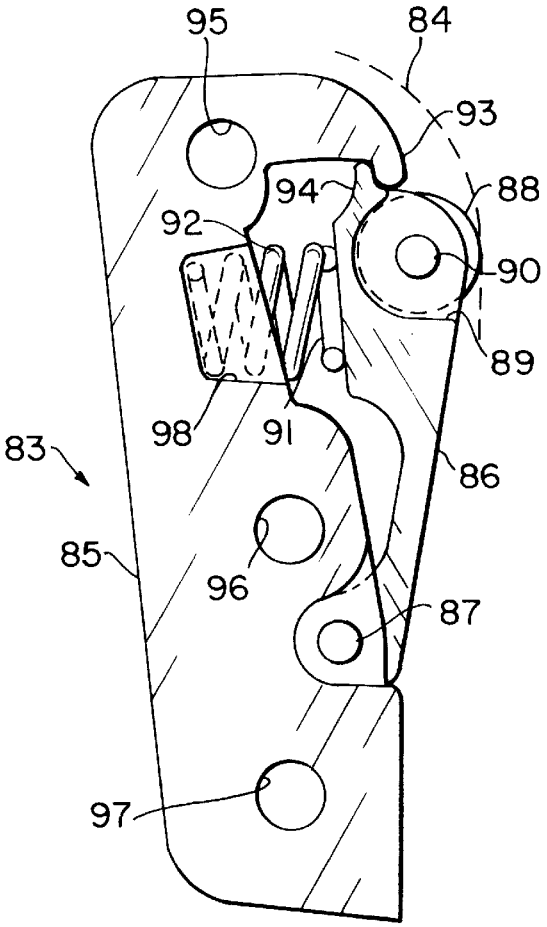
FIG. 9 is an enlarged side elevational view of a fourth embodiment of the biasing apparatus of the present invention.

The fourth embodiment of the improved biasing apparatus is illustrated at numeral 83 in FIG. 9. This embodiment is preferred for applications where the user is carrying a concealed handgun or has a holster inside the belt, for example. Support body 85 is used to mount engaging member 86 via axle or pin 87. Roller element 88 is mounted via axle 90 to the engaging member in circular slot 89. The travel limit bracket 93 limits movement of engaging member 86 via contact with upstanding boss 94. Spring 92 is mounted between boss 91 and slot 98. Bolt holes 95, 96, 97 attach the apparatus 83 to a holster as before to put roller 88 in contact with trigger guard 84.

Figure 10:
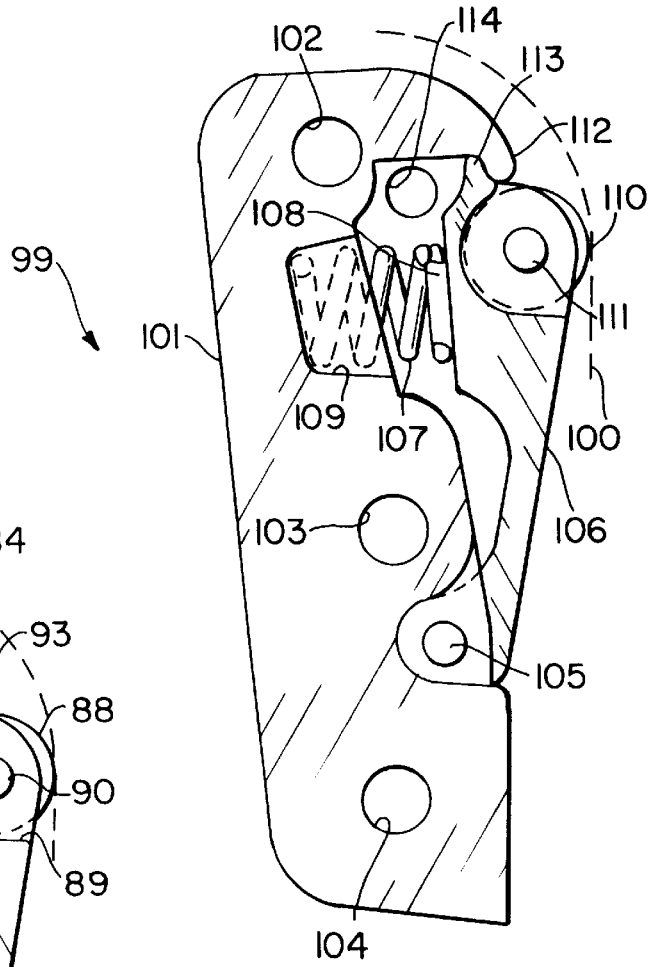
FIG. 10 is an enlarged side elevational view of a fifth embodiment of the biasing apparatus of the present invention.

In FIG. 10, the fifth embodiment of the present invention is illustrated at numeral 99. Body 101, engaging member 106 axles 105, 111, roller element 110 and spring 107, boss 108 and slot 109, bolt holes 102, 103, 104 and post 113/bracket 112 are all substantially the same as in FIG. 9. The difference in this embodiment, however, is the provision of a blocking post hole 114. As with the earlier embodiments, the present apparatus 99 is positioned against trigger guard 100 and can employ the blocking post/lever apparatus (FIGS. 4 and 6–8) to provide for additional security via the additional step of moving the lever to pull the blocking post out of the way.

Figure 11:
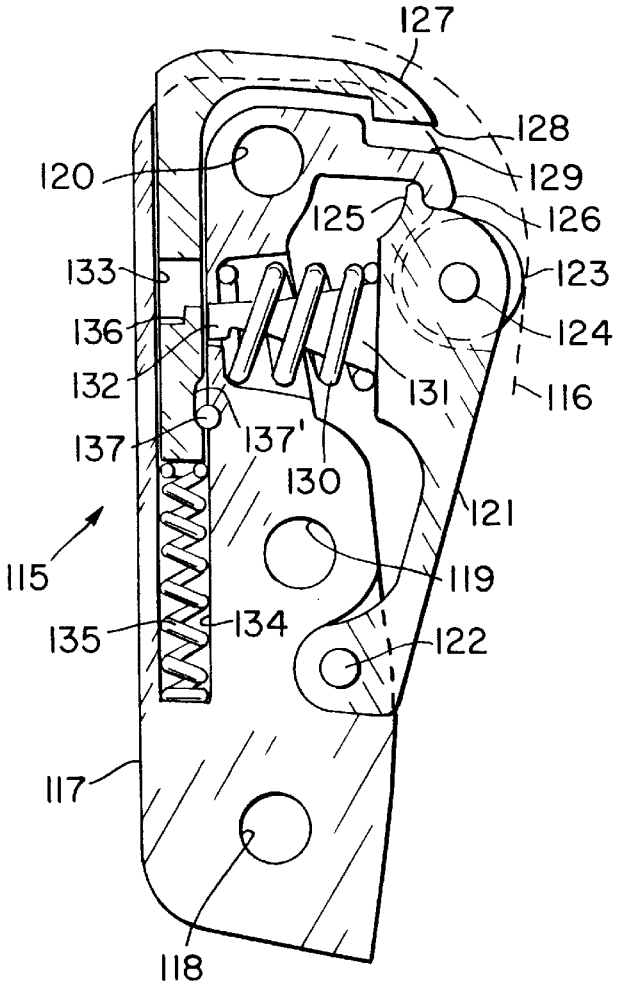
FIG. 11 is an enlarged side elevational view of a sixth embodiment of the biasing apparatus of the present invention.

A sixth embodiment of the present invention is shown at numeral 115 in FIG. 11. Support body 117 positions engaging member 121, mounted on axle 122, so that roller element 123, mounted on axle 124, is in contact with trigger guard 116. Bolt holes 118, 119, 120 are used to mount body 117 to a holster. As before, contact is between boss 125 and travel limit bracket 126. Positive locking means is provided in this embodiment and includes locking member 131 mounted inside spring 130. The rearward end portion 132 of member 131 is notched like a key-to fit into a like-shaped space 133 inside a contact element in the form of plunger member 127 having a forward lower surface 128 that is limited in downward travel by upper surface portion 129 of the body 117 adjacent bracket 126. An elongate slot 134 houses a spring 135 that biases plunger member 127 upwardly. Travel limit pin 137 mounted in slot 137' also provides for mounting of the spring-loaded plunger 127.

When a user wishes to withdraw a handgun, plunger 127 is pushed downwardly by movement of the gun in the same direction, causing contact between trigger guard 116 and plunger 127 moving slot 133 into alignment with locking member 131. Rearward portion 132 of member 131 is pushed into notch 133 via rearward movement of the gun and fits against notched surface 136 of notched space 133 in the plunger 127. Accordingly, the rearward movement of locking member 131 allows for rearward movement of engaging member 121 heretofore biased against trigger guard 116. The member 131 is also locked into notched space 133. A subsequent downward action of the gun trigger guard 116 against the plunger member 127 will allow for the release of member 132 which is otherwise held in position in a locked manner via spring 135. This is possible because the travel limit provided by pin 137 in slot 137' is sufficient for subsequent release.

Figure 12:
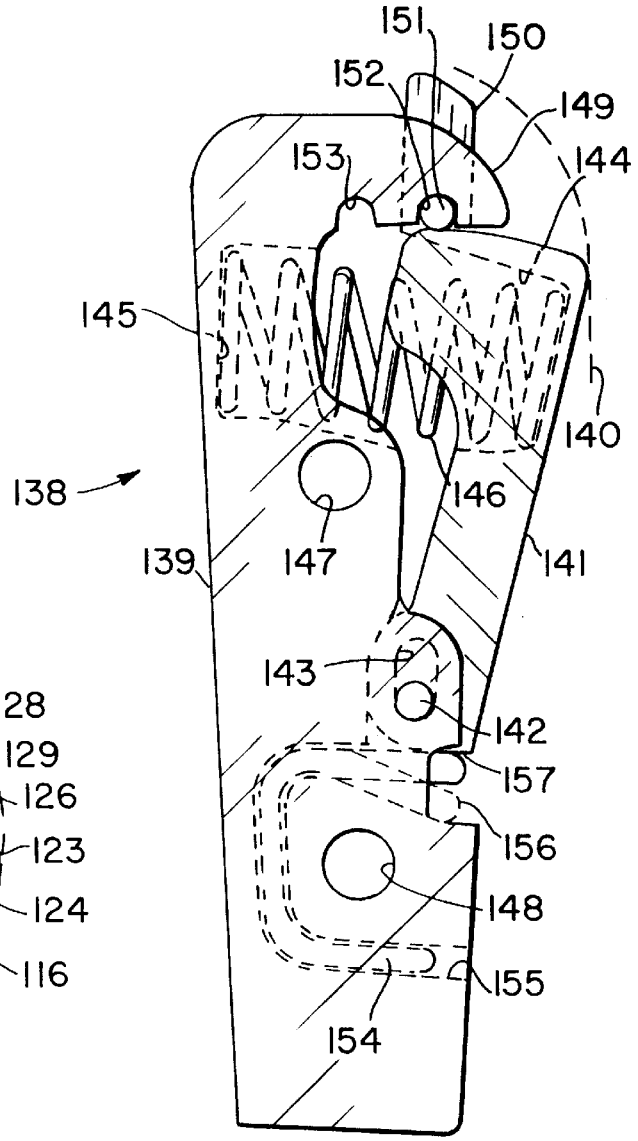
FIG. 12 is an enlarged side elevational view of a seventh embodiment of the biasing apparatus of the present invention.

FIG. 12 illustrates the preferred and seventh embodiment of the improved biasing apparatus 138 for use in high risk environments such as by uniformed security officers. Body 139 has an engaging member 141 mounted on axle pin 142 and is in contact with trigger guard 140. Pin 142 is mounted in a vertical slot 143. Spring 146 is mounted in two slots or spaces 144 and 145, bolt holes 147 and 148 are used to mount body 139 to a holster.

Engaging member 141 is spring-loaded upwardly at its lower surface 157 by spring 154 mounted in body slot or groove 155. Spring 154 via U-shaped bend 156, straddles body 139 and has an identical portion (not shown) that fits into an identical groove (not shown) on the other side of body 139. Spring 154 is integral and snaps into grooves, including groove 155, with the free ends, including end 154', which fit into opposing ends of hole 155'. Member 141 is movable downwardly against spring 154 a sufficient distance, as shown at dotted line 156, to move pin 151 mounted on post 150 downwardly out of forward locking slot 152 where it was locked into position by downward force on contact element in the form of post 150 by contact between trigger guard 140 against post 150. Once moved rearwardly by way of the user moving the gun rearwardly, pin 151 can be positioned in locking slot 153 to positively lock engaging member 141 rearward. This embodiment thus provides for positive locking of the engaging member 141 in both forward and rearward positions. Subsequent downward contact between trigger guard 140 and post 150 will allow forward movement of pin 151 to the position shown.

Figure 13:
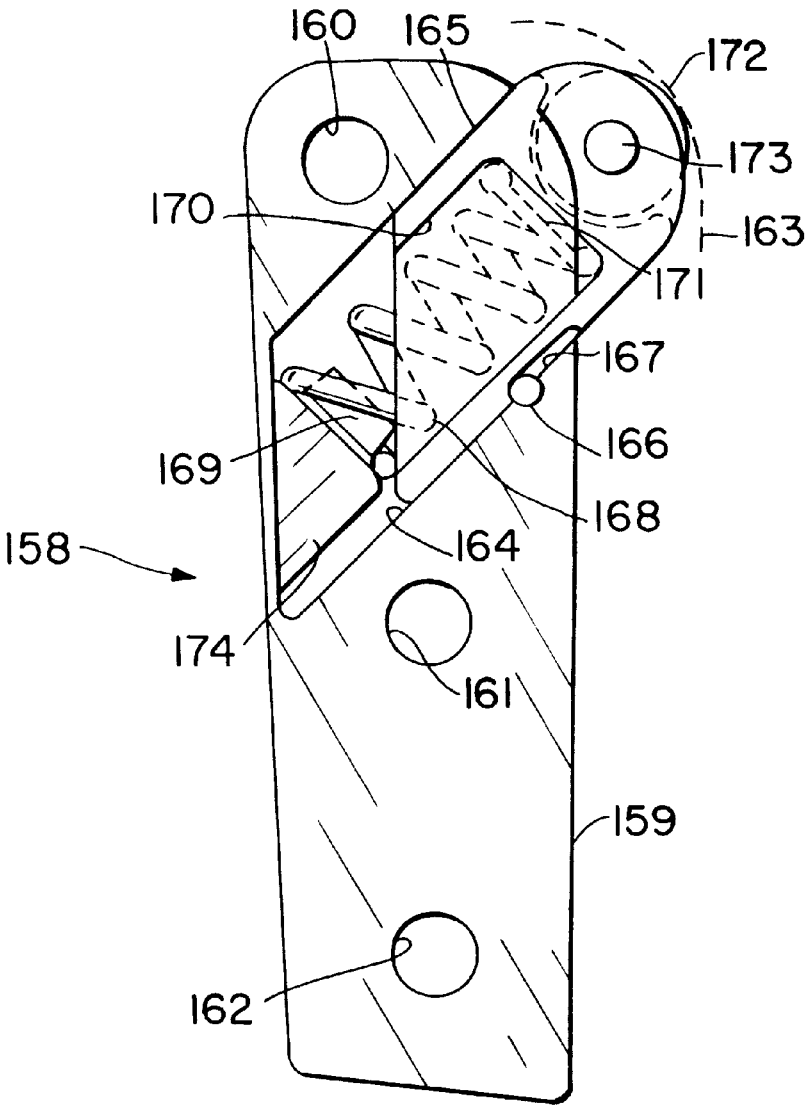
FIG. 13 is a side elevational view of an eighth embodiment of the biasing apparatus of the present invention.

The eighth embodiment of the present invention is illustrated at numeral 158 in FIG. 13. Body 159 has bolt holes 160, 161 and 162 formed therein for securing the apparatus to a holster. Trigger guard 163 is in contact with roller 172 mounted on axle 173.

An inclined slot 164 is formed in body 159 to carry a hollow engaging member 165 mounted against an internal spring 168 via bosses 169 and 171 in member interior space 170. The limit of travel is set by pin 166 in slot 167. Boss 169 is mounted to an insert block 174 formed at the lower end portion of slot 164 or machined from body 159 material. Rearward movement of a handgun will force engaging member 165 downwardly and rearwardly against the force of spring 168 via contact between trigger guard 163 and roller 172.

Figure 14:
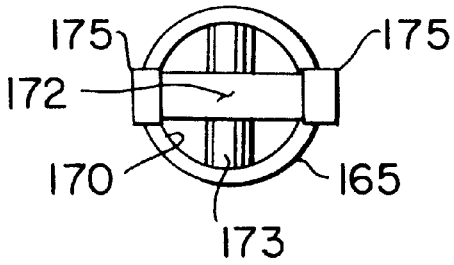
FIG. 14 is a partial top plan view of the roller element shown in FIG. 13.

FIG. 14 illustrates an alternative mounting for the roller element 172 of FIG. 13. Guides 175 are used to provide alignment and anti-rotation bias for the engaging member 165.

Finally, it is important to note the following aspects of the holster and biasing apparatus construction. All the bolt holes and blocking posts holes are preferably reinforced around their perimeter by removable grommets, T-nuts or eyelets used with the bolts to provide a secure fit. In all cases, the size and mounted position of the biasing apparatus is tailored to the specific handgun the holster is designed to carry.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising biasing means adapted to engage and force a handgun placed in said inner cavity forwardly in said holster, said stop means engaging a portion of a handgun to prevent withdrawal upwardly until a handgun is forcibly moved rearwardly against said biasing means to clear said stop means, said biasing means including an engaging member, said engaging member being mounted in the inner cavity of a holster in a manner to position said engaging member forward to engage a handgun placed in the holster, said biasing means further including selectively operable positive locking means for securing said engaging member in a first position for inhibiting withdrawal of a handgun placed in said inner cavity of the holster.

2. The holster of claim 1 wherein said biasing means includes a roller element and means for mounting said roller element to said engaging member, said roller element engaging a handgun inserted in said inner cavity, said roller element providing for minimum frictional engagement between a surface of a handgun in contact with said engaging means to provide for ease of handgun withdrawal from and insertion into the holster.

3. The holster of claim 1 wherein said positive locking means secures said engaging member in a second position for unimpeded movement of a handgun into and out of the holster.

4. The holster of claim 1 wherein said biasing means includes a spring member, said spring member being mounted between a rear portion of the holster and said engaging member for forcing said engaging member forward to engage a handgun placed in the holster.

5. The holster of claim 4 wherein said biasing means further includes a support member and securing means to secure said support member to the rear portion of the holster, said spring member being mounted between said support member and said engaging member.

6. The holster of claim 5 wherein said engaging member includes an upper end portion and a lower end portion, said support member further including mounting means for movably mounting said engaging member to said support member at said lower end portion of said engaging member.

7. In a holster for a handgun the holster having with respect to a front and back of a wearer of the holster inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of the handgun, the improvement comprising biasing apparatus to engage a handgun placed in said inner cavity, said biasing apparatus including an engaging member and a spring element, said spring element being associated with said engaging member for forcing said engaging member forwardly to engage a handgun thereby forcing a handgun forwardly for engagement by said stop means to inhibit upward withdrawal of a handgun until a handgun is forcibly moved rearwardly against said biasing means to clear said stop means, wherein said biasing apparatus further includes selectively operable positive locking means for securing said engaging member in a first position for inhibiting withdrawal of a handgun placed in said inner cavity of the holster.

8. The holster of claim 7 wherein said positive locking means secures said engaging member in a second position for unimpeded movement of a handgun into and out of the holster.

9. The holster of claim 7 wherein said biasing apparatus includes a roller element and means for mounting said roller element to said engaging member, said roller element engaging a handgun inserted in said inner cavity, said roller element providing for minimum frictional engagement between a surface of a handgun in contact with said engaging means to provide for ease of withdrawal from and insertion of a handgun into the holster.

10. The holster of claim 7 wherein said biasing apparatus further includes a support member and securing means to secure said support member to the rear portion of the holster, said spring element being mounted between said support member and said engaging member.

11. The holster of claim 10 wherein said engaging member includes an upper end portion and a lower end portion, said support member further including pivot mounting means for pivotally mounting said engaging member to said support member at said lower end portion of said engaging member.

12. The holster of claim 7 wherein said biasing apparatus includes a body having a front surface and rear surface portions and means for mounting said engaging member to said body, said spring element being mounted between said body and said engaging member, said body including an elongate vertically disposed slot formed therein and having an open upper and closed lower end portions and a first passageway formed therein between said slot above said lower portion and said front surface portion, a second spring element mounted in said lower end portion, an elongated plunger element having an upper end portion and a lower end portion mounted in said open end portion and being biased upwardly by said second spring element, said plunger element having a second passageway formed generally medially thereof and being sized substantially equal to said first passageway, said engaging member including a rearwardly disposed locking member, said locking member sized to be movable within said first and second passageways, said plunger element being selectively movable between a first upper position wherein said second passageway is not positioned adjacent to said first passageway for inhibiting rearward movement of said engaging member and a second lower position wherein said second passageway is aligned adjacent said first passageway, said locking member being movable rearwardly into said second passageway when a handgun is moved rearwardly after said plunger element has been pushed downwardly to said second position by downward contact between a handgun and said upper portion of said plunger element.

13. In a holster for a handgun the holster having with respect to a front and back of a wearer of the holster inner and outer spaced substantially rigid sidewalls joined together along the forward and rear portions thereof to define an inner cavity and an open top portion for receiving a handgun therein and for removing a handgun therefrom, substantially rigid stop means formed in said inner cavity to engage a portion of a handgun when it is in the holster to inhibit withdrawal of a handgun prior to rearward movement of a handgun, the improvement comprising biasing means for engaging a handgun placed in said inner cavity, said biasing means including an engaging member and a spring element, said spring element being mounted between a rear portion of the holster and said engaging member for forcing said engaging member forwardly to engage a handgun thereby forcing a handgun forwardly for engagement by said stop means to inhibit withdrawal of a handgun upwardly, and selective positive locking means to substantially inhibit said engaging member from moving rearwardly to permit withdrawal of a handgun until movement of said locking means in a predetermined direction.

14. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising biasing means adapted to engage and force a handgun placed in said inner cavity against said stop means, said biasing means including an engaging member, said engaging member being mounted in the inner cavity of a holster in a manner to position said engaging member forward to engage a handgun placed in the holster, said biasing means further including a roller element and means for mounting said roller element to said engaging member, said roller element engaging a handgun inserted in said inner cavity, said roller element providing for minimum frictional engagement between a surface of a handgun in contact with said engaging means to provide for ease of handgun withdrawal from and insertion into the holster.

15. The holster of claim 14 wherein said biasing apparatus further includes selectively operable positive locking means for securing said engaging member in a first position for inhibiting withdrawal of a handgun from the holster and a second position for unimpeded movement of a handgun into and out of the holster.

16. The holster of claim 14 wherein said biasing means includes selectively movable blocking means mounted to the holster and movable between first and second positions for inhibiting rearward movement of said engaging member when said blocking means is in said first position and permitting rearward movement of said engaging member when said blocking means is in said second position.

17. The holster of claim 16 wherein said selectively movable blocking means includes a blocking element and a lever mounted to the holster and movable by contact with a finger of a user while engaging the handgun for withdrawal of the handgun, said blocking element attached to said lever and movable thereby between said first and second positions, said blocking element positioned rearwardly of said engaging member in said first position to make contact with said engaging member when an attempt is made to move said engaging member rearwardly.

18. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising biasing means adapted to engage and force a handgun placed in said inner cavity against said stop means, said biasing means including an engaging member, said engaging member being mounted in the inner cavity of a holster in a manner to position said engaging member forward to engage a handgun placed in the holster, said biasing means further including selectively operable positive locking means for securing said engaging member in a second position for unimpeded movement of a handgun into and out of the holster.

19. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising spring biasing means located within the holster and including an engaging member adapted to engage and force a handgun placed in said inner cavity against said stop means, said spring biasing means including means located within the holster for limiting forward movement of said engaging member to a maximum forward position to assure unobstructed insertion of a handgun into the holster.

20. The holster of claim 19 wherein said biasing means further includes selectively operable positive locking means for securing said engaging member in a first position for inhibiting withdrawal of a handgun from the holster and a second position for unimpeded movement of a handgun into and out of the holster.

21. The holster of claim 19 wherein said spring biasing means includes selectively movable blocking means mounted to the holster and movable between first and second positions for inhibiting rearward movement of said engaging member when said blocking means is in said first position and permitting rearward movement of said engaging member when said blocking means is in said second position.

22. The holster of claim 21 wherein said selectively movable blocking means includes a blocking element and a lever mounted to the holster, said blocking element attached to said lever and movable thereby between said first and second positions, said blocking element positioned rearwardly of said engaging member in said first position to make contact with said engaging member when an attempt is made to move said engaging member rearwardly.

23. The holster of claim 19 wherein said spring biasing means includes selectively operable blocking means for securing said engaging member in a first position for inhibiting withdrawal of a handgun and a second position permitting withdrawal, said blocking means including an element operable by a finger of a wearer in gripping a handgun holsterable in said holster.

24. The holster of claim 23 wherein said element includes a lever attached to said holster and a peg mounted to said lever and positioned to substantially inhibit rearward movement of said engaging member thereby retaining the handgun in said holster.

25. In a holster for a handgun in which the holster including, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising spring biasing means adapted to engage and force a handgun placed in said inner cavity against said stop means, said biasing means including a body, an engaging member movably attached to said body, and spring means mounted between said body and said engaging member for forcing said engaging member against a handgun, said spring biasing including a roller element and means for mounting said roller elememt to said engaging member, said roller element engaging a handgun inserted in said inner cavity, said roller element providing for minimum frictional engagement between a surface of a handgun in contact with said engaging means to provide for ease of withdrawal from and insertion of a handgun into the holster.

26. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising biasing means including an engaging member adapted to engage and force a handgun placed in said inner cavity against said stop means, said biasing means including means for limiting forward movement of said engaging member to a maximum forward position to assure unobstructed insertion of a handgun into the holster, said biasing means further includes a spring, and a roller element, said roller element providing for minimum frictional engagement between a surface of a handgun in contact therewith to provide for ease of handgun withdrawal from and insertion into the holster.

27. In a holster for a handgun in which the holster includes, with respect to a front and back of a wearer of the holster, inner and outer spaced substantially rigid sidewalls formed to define an inner cavity and an open top portion for receiving a handgun therein and for removing a handgun therefrom, stop means located in said inner cavity to engage a portion of a handgun in the holster to inhibit withdrawal of a handgun upwardly prior to rearward movement of a handgun, the improvement comprising biasing means adapted to engage and force a handgun placed in said inner cavity forwardly in said holster, said stop means engaging a portion of a handgun to prevent withdrawal upwardly until a handgun is forcibly moved rearwardly against said biasing means to clear said stop means said biasing means including an engaging member, said engaging member being mounted in the inner cavity of a holster in a manner to position said engaging member forward to engage a handgun placed in the holster, said biasing means includes selectively operable blocking means for securing said engaging member in a first position for inhibiting withdrawal of a handgun and a second position permitting withdrawal, said blocking means including an element operable by movement of a handgun holsterable in said holster in a predetermined general downwardly direction.

28. The holster of claim 27 wherein said element includes a plunger engageable by a portion of a handgun.

* * * * *